US010160085B2

(12) United States Patent
Xue et al.

(10) Patent No.: US 10,160,085 B2
(45) Date of Patent: Dec. 25, 2018

(54) SIZE-ADJUSTABLE ONLINE WHEEL DEBURRING DEVICE

(71) Applicant: CITIC Dicastal CO., LTD, Qinhuangdao (CN)

(72) Inventors: Bowen Xue, Qinhuangdao (CN); Jiandong Guo, Qinhuangdao (CN)

(73) Assignee: CITIC Dicastal CO., LTD, Qinhuangdao (CN)

( * ) Notice: Subject to any disclaimer, the term of this patent is extended or adjusted under 35 U.S.C. 154(b) by 37 days.

(21) Appl. No.: 15/392,595

(22) Filed: Dec. 28, 2016

(65) Prior Publication Data

US 2017/0182619 A1 Jun. 29, 2017

(30) Foreign Application Priority Data

Dec. 29, 2015 (CN) ..... 2015 1 1006534

(51) Int. Cl.

| | |
|---|---|
| ***B24B 9/04*** | (2006.01) |
| ***B24B 29/04*** | (2006.01) |
| ***B24B 5/01*** | (2006.01) |
| ***B24B 5/12*** | (2006.01) |
| ***B24B 5/44*** | (2006.01) |
| ***B24B 29/00*** | (2006.01) |

(52) U.S. Cl.

CPC ..... *B24B 9/04* (2013.01); *B24B 5/01* (2013.01); *B24B 5/12* (2013.01); *B24B 5/44* (2013.01); *B24B 29/005* (2013.01); *B24B 29/04* (2013.01)

(58) Field of Classification Search

CPC .... B24B 5/01; B24B 5/12; B24B 5/18; B24B 5/44; B24B 9/04; B24B 29/005; B24B 29/04

USPC ..... 451/209, 210

See application file for complete search history.

(56) References Cited

U.S. PATENT DOCUMENTS 3,258,804 A * 7/1966 Fowle ..... B24B 5/225 15/104.011

4,216,560 A * 8/1980 Schmidt ..... B24B 41/06 15/268

(Continued)

FOREIGN PATENT DOCUMENTS

JP 3044289 B2 * 5/2000

JP 3091417 B2 * 9/2000

*Primary Examiner* — Eileen Morgan

(74) *Attorney, Agent, or Firm* — Howard IP Law, PLLC; Jeremy Howard

(57) ABSTRACT

A size-adjustable online wheel deburring device for removing burs from wheels, including a machine frame, a synchronous clamping and rotating system that enables the wheels to rotate in a clamped state, and a brush adjustment system, the clamping and rotating system and the brush adjustment system being arranged in the machine frame. The brush adjustment system includes a left brush adjustment system including a left brush and a right brush adjustment including a right brush, the left brush adjustment system and the right brush adjustment being arranged in symmetry. The left brush and the right brush are separately adjusted to desired positions through a left gear rack and a right gear rack according to detected diameters of the wheels, the left gear rack being fixed on a side face of the left supporting block and the right gear rack being connected with a right fixing block below the right brush.

1 Claim, 3 Drawing Sheets

(56) References Cited

U.S. PATENT DOCUMENTS

| | | | | | |
|---|---|---|---|---|---|
| 4,527,300 | A * | 7/1985 | Kunde | B24B 29/04 | 15/88.2 |
| 4,532,665 | A * | 8/1985 | Evans | B24B 29/04 | 15/88.3 |
| 5,134,807 | A * | 8/1992 | Keefe | B24B 7/16 | 451/259 |
| 5,161,281 | A * | 11/1992 | Hanen | B08B 1/04 | 15/88.3 |
| 5,762,542 | A * | 6/1998 | Sandvold | B24B 9/002 | 451/188 |
| 6,217,424 | B1 * | 4/2001 | Stephens | B24B 5/44 | 451/254 |
| 7,351,130 | B1 * | 4/2008 | Chang | B24B 7/06 | 451/11 |
| 9,039,490 | B2 * | 5/2015 | Kelly | F01D 5/005 | 29/889.1 |
| 2007/0037497 | A1 * | 2/2007 | Tanaka | B24B 5/44 | 451/312 |
| 2013/0102233 | A1 * | 4/2013 | Cheon | B24B 27/033 | 451/331 |
| 2014/0194038 | A1 * | 7/2014 | Lowe | B24B 9/04 | 451/11 |

* cited by examiner

SIZE-ADJUSTABLE ONLINE WHEEL DEBURRING DEVICE

This application claims priority from CN201511006534.6, filed on Dec. 29, 2015, the entire content of which is incorporated herein by reference.

TECHNICAL FIELD

The present invention relates to a wheel deburring device for removing burrs from wheels, and in particular to a size-adjustable online wheel deburring device.

BACKGROUND ART

At present, for almost all wheel production enterprises, a large-disc brush is used for carrying out deburring on a back cavity of a wheel on special equipment, this mode has a still permissible effect on wheels with simple front shapes, however, for a majority of wheels, the deburring effect hardly meets use requirements; and almost all wheel production enterprises mixed-line production, i.e., the wheels of different sizes will wait for deburring on a physical distribution roller way simultaneously, at present, no deburring equipment, which can meet deburring requirements of the wheels of various sizes and meanwhile be used for carrying out targeted processing on burrs formed at flange and spoke corners according to formation modes distribution characteristics of wheel burrs, is present yet, and to rapidly remove the burrs at the flange and spoke corners in transverse and longitudinal directions is very necessary.

SUMMARY OF THE INVENTION

An object of the present invention is to provide a wheel deburring device which can automatically adjust sizes of brushes according to sizes of wheels so as to achieve mixed-line automatic online deburring for the wheels and can be used for carrying out focused processing on corners of flange roots and corners of rim roots.

A size-adjustable online wheel deburring device for removing burs from wheels, comprising a machine frame (1), a synchronous clamping and rotating system that enables the wheels to rotate in a clamped state, and a brush adjustment system, the clamping and rotating system and the brush adjustment system being arranged in the machine frame, wherein the brush adjustment system comprises a left brush adjustment system including a left brush (15) and a right brush adjustment including a right brush (25), the left brush adjustment system and the right brush adjustment being arranged in symmetry; wherein the left brush (15) is connected with a slide rail of a left guide rail (12) through a left supporting block (13), and a sliding block of the left guide rail (12) is fixed above a fixing plate (30); wherein the right brush (25) is connected with a slide rail of a right guide rail (29) through a right supporting block (28), and a sliding block of the right guide rail (29) is fixed above the fixing plate (30); wherein oblique motors (45) are fixed on oblique plates (46) above the left brush (15) and oblique brushes (47) are provided at output ends of the oblique motors (45); and wherein during operation, the left brush (15) and the right brush (25) are separately adjusted to desired positions through a left gear rack (14) and a right gear rack (27) according to detected diameters of the wheels, the left gear rack (14) being fixed on a side face of the left supporting block (13) and the right gear rack (27) being connected with a right fixing block (26) below the right brush (25).

The synchronous clamping and rotating system comprises a first drive motor (2), lifting cylinders (3), a bottom plate (4), a rising and falling plate (5), guide sleeves (6), guide posts (7), a large bearing block (8), a driving shaft (9), a top plate (10), first gears (11), synchronous gear racks (16), synchronous guide rails (17), a left sliding plate (18), minor bearing blocks (19), synchronous shafts (20), V-type rollers (21), a right sliding plate (22), a clamping cylinder (23) and a second drive motor (24). Four guide posts (7) are fixed between the bottom plate (4) and the top plate (10), and four guide sleeves (6) matched with the guide posts (7) are mounted on the rising and falling plate (5). The first drive motor (2) is mounted below the rising and falling plate (5), the large bearing block (8) is mounted above the rising and falling plate (5), the driving shaft (9) is mounted in the large bearing block (8) through a bearing, and an output end of the first drive motor (2) is connected with the lower end of the driving shaft (9). Two lifting cylinders (3) are mounted on the bottom plate (4), and output ends of the two lifting cylinders (3) are hinged to the downside of the rising and falling plate (5). Two synchronous gear racks (16) are fixed below each of the left sliding plate (18) and the right sliding plate (22), two minor bearing blocks (19) are fixed above each of the left sliding plate (18) and the right sliding plate (22), and the left sliding plate (18) and the right sliding plate (22) are mounted above the top plate (10) through the synchronous guide rails (17). The synchronous shafts (20), of which upsides are separately provided with the V-type rollers (21), are separately mounted inside the minor bearing blocks (19) through bearings. The drive motor (24) is fixed below the right sliding plate (22), and an output end of the second drive motor (24) is connected with one of the synchronous shafts (20). The clamping cylinder (23) is fixed on the side face of the machine frame (1), and an output end of the clamping cylinder (23) is connected with the right sliding plate (22). The synchronous gear racks (16) are engaged with the first gears (11) mounted above the top plate (10).

The brush adjustment system comprises a left guide rail (12), a left supporting block (13), a left gear rack (14), a left brush (15), a right brush (25), a right fixing block (26), a right gear rack (27), a right supporting block (28), a right guide rail (29), a fixing plate (30), first belt pulleys (31), servo motors (32), synchronizing belts (33), driving cylinders (34), revolving rings (35), second belt pulleys (36), spline shafts (37), spline housings (38), first bearing blocks (39), second synchronizing belts (40), third belt pulleys (41), jacking blocks (42), second gears (43), supporting frames (44), oblique motors (45), oblique plates (46), oblique brushes (47), tensioning cylinders (48), tensioning guide rails (49), sliding blocks (50), second bearing blocks (51), first shafts (52), flange brushes (53), second shafts (54), third bearing blocks (55), fourth belt pulleys (56) and fifth belt pulleys (57). The servo motors (32), of which output ends are provided with the first belt pulleys (31), and the driving cylinders (34) are mounted below the left of the fixing plate (30) through transition flanges; the first bearing blocks (39) are fixed above the fixing plate (30), and the spline housings (38), of which downsides are fixedly provided with the second belt pulleys (36) and upsides are fixedly provided with the third belt pulleys (41), are mounted in the first bearing blocks (39) through bearings; the spline shafts (37) are matched with the spline housings (38), the jacking blocks (42) are fixed above the spline shafts (37), and the revolving rings (35) are fixed below the spline shafts (37);

output ends of the driving cylinders (34) are connected with downsides of the revolving rings (35); the first belt pulleys (31) and the second belt pulleys (36) are connected through the first synchronizing belts (33); the supporting frames (44) are fixed above the fixing plate (30), and the second gears (43) are mounted on the supporting frames (44); the sliding blocks (50) are mounted above the fixing plate (30) through the tensioning guide rails (49), and the second bearing blocks (51) are fixed above the sliding blocks (50); the first shafts (52), of which output ends are provided with the fourth belt pulleys (56), are mounted inside the second bearing blocks (51) through bearings; the tensioning cylinders (48) are also fixed above the fixing plate (30), and output ends of the tensioning cylinders (48) are connected with the sliding blocks (50); the left brush (15) is connected with a slide rail of the left guide rail (12) through the left supporting block (13), and a sliding block of the left guide rail (12) is fixed above the fixing plate (30); the left gear rack (14) is fixed on the side face of the left supporting block (13) and is engaged with the second gears (43); the right brush (25) is connected with a slide rail of the right guide rail (29) through the right supporting block (28), and a sliding block of the right guide rail (29) is fixed above the fixing plate (30); the right gear rack (27) is connected with the right fixing block (26) below the right brush (25); the right gear rack (27) is also engaged with the second gears (43); the bearing blocks (55) are fixed below the right brush (25); the second shafts (54), of which upper ends are provided with the flange brushes (53) and lower ends are provided with the fifth belt pulleys (57), are mounted inside the third bearing blocks (55) through bearings; and the third belt pulleys (41), the fourth belt pulleys (56) and the fifth belt pulleys (57) are connected through the second synchronizing belts (40). The oblique motors (45), of which output ends are provided with the oblique brushes (47), are fixed on the oblique plates (46) above the left brush (15).

The device comprises two brush adjustment systems which are in bilateral symmetry.

During actual use, the synchronous clamping and rotating system enables a wheel to rotate in a clamped state, and the diameter of the wheel is detected; the driving cylinders enable the spline shafts to rise so as to enable the jacking blocks to be matched with the second gears, and the servo motors drive the second gears to rotate through the first synchronizing belts; the left brush and the right brush are separately adjusted to appropriate positions through the left gear rack and the right gear rack according to the detected diameter of the wheel; the second driving cylinders enable the spline shafts to fall so as to enable the jacking blocks to be separated from the gears; the servo motors drive the flange brushes to rotate through the first synchronizing belts and the second synchronizing belts; the fourth belt pulleys guarantee that the second synchronizing belts are always in a tensioned state after the left brush and the right brush are adjusted to the appropriate positions; the oblique motors drive the oblique brushes to rotate; and the drive motor enables the brush adjustment systems which are in bilateral symmetry to rotate through the driving shaft, the two lifting cylinders lift the wheel through the guide posts, and the aim of deburring can be achieved when each brush is in contact with a back cavity of the wheel.

When in use, the wheel deburring device can automatically adjust the sizes of the brushes according to the sizes of the wheels so as to achieve mixed-line automatic online deburring for the wheels and can be used for carrying out focused processing on the corners of the flange roots and the corners of the rim roots; and meanwhile, the wheel deburring device has the characteristics of high degree of automation, advanced technology, simple structure and safe and stable performance.

Figure 1:
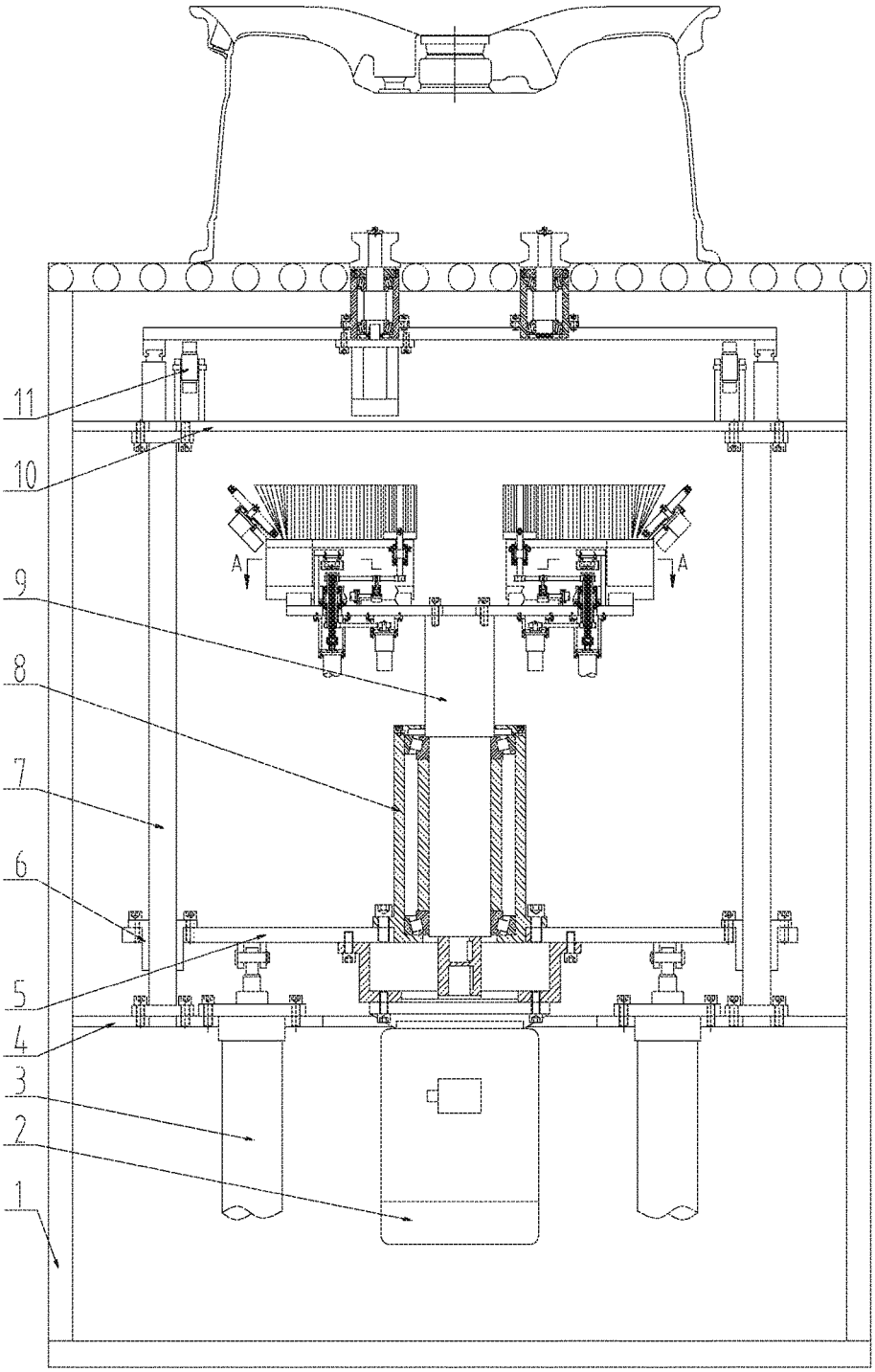
FIG. 1 is a front view of a size-adjustable online wheel deburring device.
Figure 2:
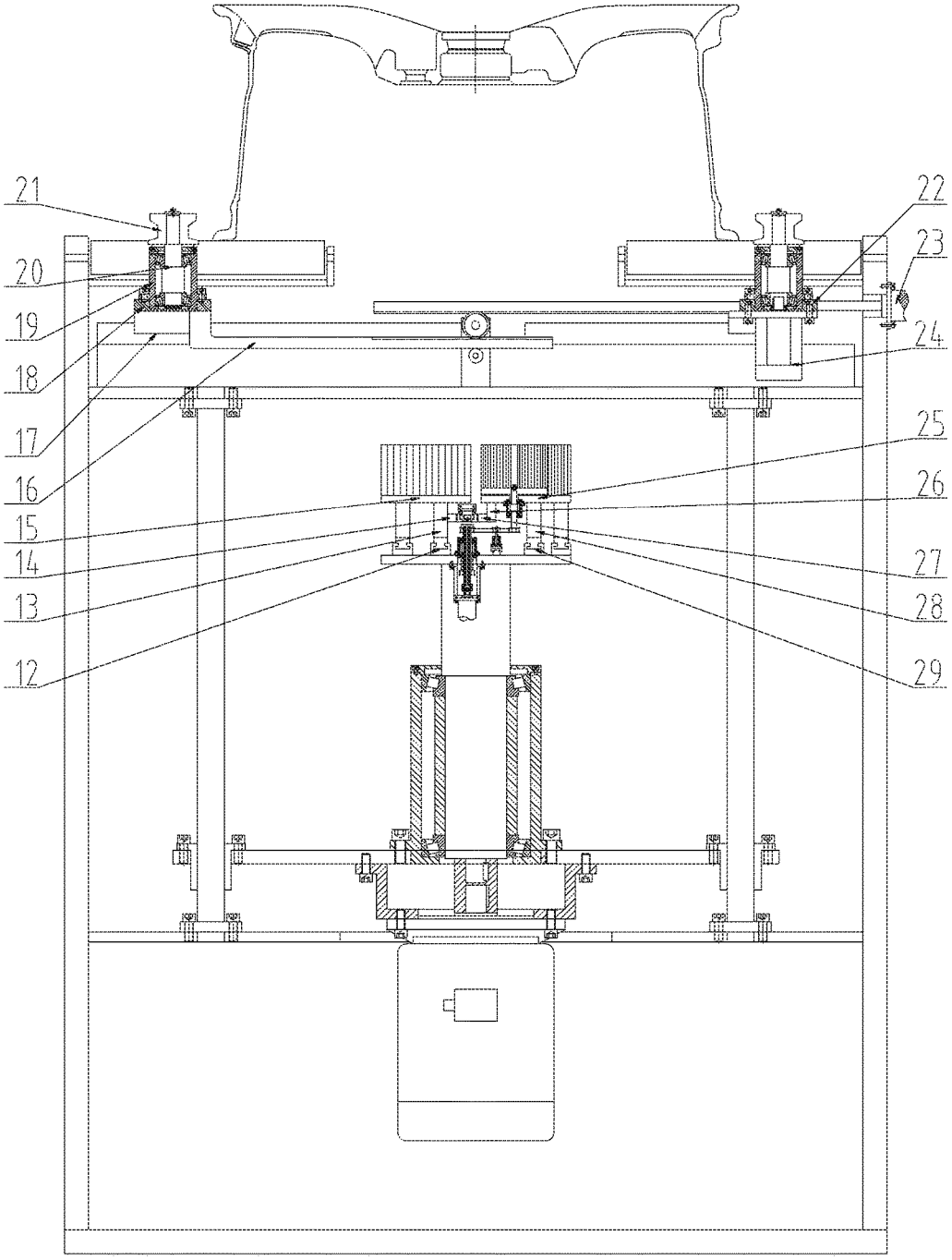
FIG. 2 is a left view of a size-adjustable online wheel deburring device.
Figure 3:
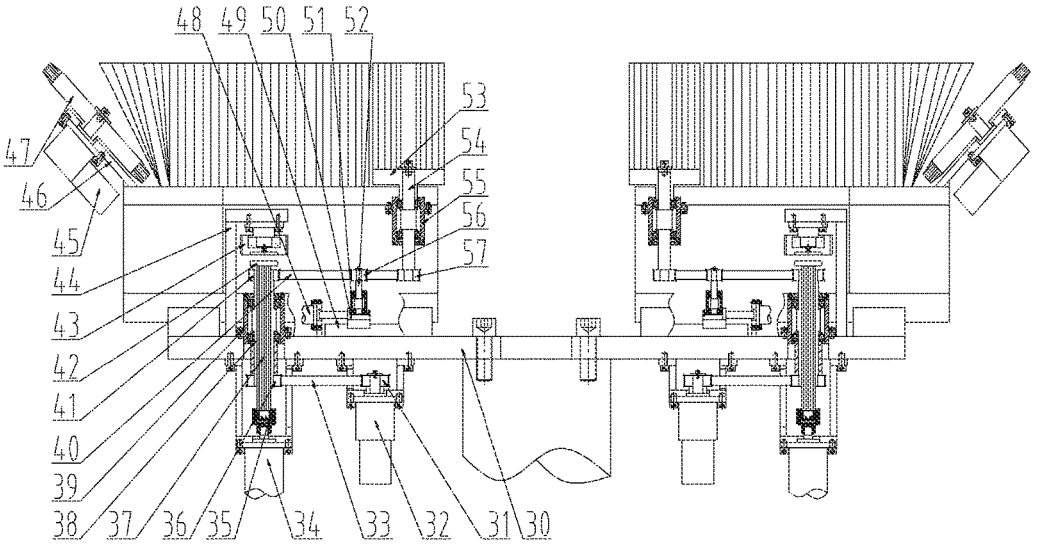
FIG. 3 is a local front view of a size-adjustable online wheel deburring device.
Figure 4:
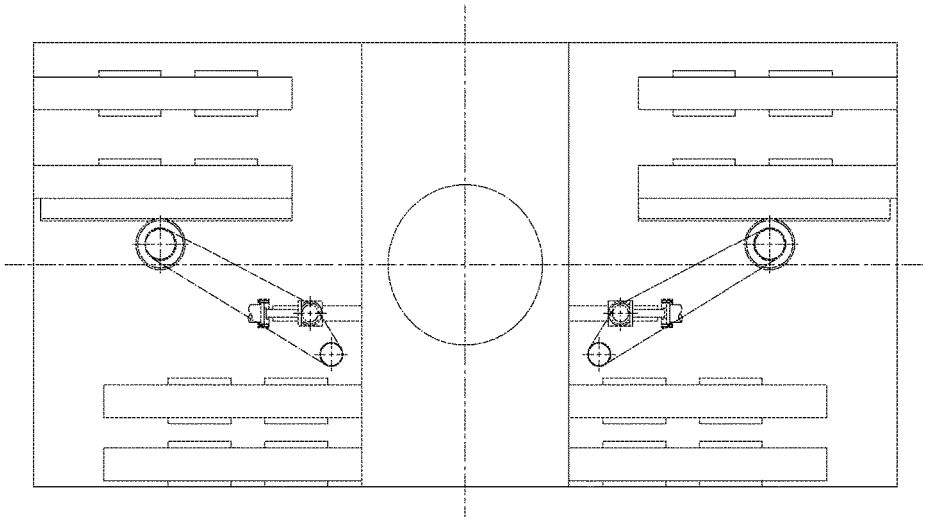
FIG. 4 is an A-direction sectional view of a size-adjustable online wheel deburring device.

In the figures, numeric symbols are as follows: 1—machine frame, 2—first drive motor, 3—lifting cylinder, 4—bottom plate, 5—rising and falling plate, 6—guide sleeve, 7—guide post, 8—large bearing block, 9—driving shaft, 10—top plate, 11—first gear, 12—left guide rail, 13—left supporting block, 14—left gear rack, 15—left brush, 16—synchronous gear rack, 17—synchronous guide rail, 18—left sliding plate, 19—minor bearing block, 20—synchronous shaft, 21—V-type roller, 22—right sliding plate, 23—clamping cylinder, 24—second drive motor, 25—right brush, 26—right fixing block, 27—right gear rack, 28—right supporting block, 29—right guide rail, 30—fixing plate, 31—first belt pulley, 32—servo motor, 33—first synchronizing belt, 34—driving cylinder, 35—revolving ring, 36—second belt pulley, 37—spline shaft, 38—spline housing, 39—first bearing block, 40—second synchronizing belt, 41—third belt pulley, 42—jacking block, 43—second gear, 44—supporting frame, 45—oblique motor, 46—oblique plate, 47—oblique brush, 48—tensioning cylinder, 49—tensioning guide rail, 50—sliding block, 51—second bearing block, 52—first shaft, 53—flange brush, 54—second shaft, 55—third bearing block, 56—fourth belt pulley and 57—fifth belt pulley.

DETAILED DESCRIPTION OF THE INVENTION

In the following, the details and working conditions of a specific device provided by the present invention are described in combination with the figures.

A size-adjustable online wheel deburring device comprises a synchronous clamping and rotating system, a brush adjustment system and a machine frame 1.

The synchronous clamping and rotating system comprises a first drive motor 2, lifting cylinders 3, a bottom plate 4, a rising and falling plate 5, guide sleeves 6, guide posts 7, a large bearing block 8, a driving shaft 9, a top plate 10, first gears 11, synchronous gear racks 16, synchronous guide rails 17, a left sliding plate 18, minor bearing blocks 19, synchronous shafts 20, V-type rollers 21, a right sliding plate 22, a clamping cylinder 23 and a second drive motor 24. Four guide posts 7 are fixed between the bottom plate 4 and the top plate 10, and four guide sleeves 6 matched with the guide posts 7 are mounted on the rising and falling plate 5. The first drive motor 2 is mounted below the rising and falling plate 5, the large bearing block 8 is mounted above the rising and falling plate 5, the driving shaft 9 is mounted in the large bearing block 8 through a bearing, and an output end of the first drive motor 2 is connected with the lower end of the driving shaft 9. Two lifting cylinders 3 are mounted on the bottom plate 4, and output ends of the two lifting cylinders 3 are hinged to the downside of the rising and falling plate 5. Two synchronous gear racks 16 are fixed below each of the left sliding plate 18 and the right sliding plate 22, two minor bearing blocks 19 are fixed above each of the left sliding plate 18 and the right sliding plate 22, and the left sliding plate 18 and the right sliding plate 22 are mounted above the top plate 10 through the synchronous guide rails 17. The synchronous shafts 20, of which upsides are separately provided with the V-type rollers 21, are separately mounted inside the minor bearing blocks 19 through bearings. The second drive motor 24 is fixed below the right sliding plate 22, and an output end of the second drive motor 24 is connected with one of the synchronous shafts 20. The clamping cylinder 23 is fixed on the side face of the machine frame 1, and an output end of the clamping cylinder 23 is connected with the right sliding plate 22. The synchronous gear racks 16 are engaged with the first gears 11 mounted above the top plate 10.

The brush adjustment system comprises a left guide rail 12, a left supporting block 13, a left gear rack 14, a left brush 15, a right brush 25, a right fixing block 26, a right gear rack 27, a right supporting block 28, a right guide rail 29, a fixing plate 30, first belt pulleys 31, servo motors 32, first synchronizing belts 33, driving cylinders 34, revolving rings 35, second belt pulleys 36, spline shafts 37, spline housings 38, first bearing blocks 39, second synchronizing belts 40, third belt pulleys 41, jacking blocks 42, second gears 43, supporting frames 44, oblique motors 45, oblique plates 46, oblique brushes 47, tensioning cylinders 48, tensioning guide rails 49, sliding blocks 50, second bearing blocks 51, first shafts 52, flange brushes 53, second shafts 54, third bearing blocks 55, fourth belt pulleys 56 and fifth belt pulleys 57. The servo motors 32, of which output ends are provided with the first belt pulleys 31, and the driving cylinders 34 are mounted below the left of the fixing plate 30 through transition flanges; the first bearing blocks 39 are fixed above the fixing plate 30, and the spline housings 38, of which downsides are fixedly provided with the second belt pulleys 36 and upsides are fixedly provided with the third belt pulleys 41, are mounted in the first bearing blocks 39 through bearings; the spline shafts 37 are matched with the spline housings 38, the jacking blocks 42 are fixed above the spline shafts 37, and the revolving rings 35 are fixed below the spline shafts 37; output ends of the driving cylinders 34 are connected with downsides of the revolving rings 35; the first belt pulleys 31 and the second belt pulleys 36 are connected through the first synchronizing belts 33; the supporting frames 44 are fixed above the fixing plate 30, and the second gears 43 are mounted on the supporting frames 44; the sliding blocks 50 are mounted above the fixing plate 30 through the tensioning guide rails 49, and the second bearing blocks 51 are fixed above the sliding blocks 50; the first shafts 52, of which output ends are provided with the fourth belt pulleys 56, are mounted inside the second bearing blocks 51 through bearings; the tensioning cylinders 48 are also fixed above the fixing plate 30, and output ends of the tensioning cylinders 48 are connected with the sliding blocks 50; the left brush 15 is connected with a slide rail of the left guide rail 12 through the left supporting block 13, and a sliding block of the left guide rail 12 is fixed above the fixing plate 30; the left gear rack 14 is fixed on the side face of the left supporting block 13 and is engaged with the second gears 43; the right brush 25 is connected with a slide rail of the right guide rail 29 through the right supporting block 28, and a sliding block of the right guide rail 29 is fixed above the fixing plate 30; the right gear rack 27 is connected with the right fixing block 26 below the right brush 25; the right gear rack 27 is also engaged with the second gears 43; the third bearing blocks 55 are fixed below the right brush 25; the second shafts 54, of which upper ends are provided with the flange brushes 53 and lower ends are provided with the fifth belt pulleys 57, are mounted inside the third bearing blocks 55 through bearings; and the third belt pulleys 41, the fourth belt pulleys 56 and the fifth belt pulleys 57 are connected through the second synchronizing belts 40. The oblique motors 45, of which output ends are provided with the oblique brushes 47, are fixed on the oblique plates 46 above the left brush 15.

The device comprises two brush adjustment systems which are in bilateral symmetry.

During work, the synchronous clamping and rotating system enables a wheel to rotate in a clamped state, and the diameter of the wheel is detected; the driving cylinders 34 enable the spline shafts 37 to rise so as to enable the jacking blocks 42 to be matched with the second gears 43, and the servo motors 32 drive the second gears 43 to rotate through the first synchronizing belts 33; the left brush 15 and the right brush 25 are separately adjusted to appropriate positions through the left gear rack 14 and the right gear rack 27 according to the detected diameter of the wheel; the driving cylinders 34 enable the spline shafts 37 to fall so as to enable the jacking blocks 42 to be separated from the second gears 43; the servo motors 32 drive the flange brushes 53 to rotate through the first synchronizing belts 33 and the second synchronizing belts 40; the fourth belt pulleys 56 guarantee that the second synchronizing belts 40 are always in a tensioned state after the left brush 15 and the right brush 25 are adjusted to the appropriate positions; the oblique motors 45 drive the oblique brushes 47 to rotate; and the drive motor 2 enables the brush adjustment systems which are in bilateral symmetry to rotate through the driving shaft 9, the two lifting cylinders 3 lift the wheel through the guide posts 7, and the aim of deburring can be achieved when each brush is in contact with a back cavity of the wheel.

What is claimed is:

1. A size-adjustable online wheel deburring device for removing burs from wheels, comprising a machine frame (1), a synchronous clamping and rotating system that enables the wheels to rotate in a clamped state, and a brush adjustment system, the clamping and rotating system and the brush adjustment system being arranged in the machine frame, wherein the brush adjustment system comprises a left brush adjustment system including a left brush (15) and a right brush adjustment including a right brush (25), the left brush adjustment system and the right brush adjustment being arranged in symmetry; wherein the left brush (15) is connected with a slide rail of a left guide rail (12) through a left supporting block (13), and a sliding block of the left guide rail (12) is fixed above a fixing plate (30); wherein the right brush (25) is connected with a slide rail of a right guide rail (29) through a right supporting block (28), and a sliding block of the right guide rail (29) is fixed above the fixing plate (30); wherein oblique motors (45) are fixed on oblique plates (46) above the left brush (15) and oblique brushes (47) are provided at output ends of the oblique motors (45); and wherein during operation, the left brush (15) and the right brush (25) are separately adjusted to desired positions through a left gear rack (14) and a right gear rack (27) according to detected diameters of the wheels, the left gear rack (14) being fixed on a side face of the left supporting block (13) and the right gear rack (27) being connected with a right fixing block (26) below the right brush (25).

* * * * *